US010774994B2

(12) United States Patent
Li

(10) Patent No.: US 10,774,994 B2
(45) Date of Patent: Sep. 15, 2020

(54) SPOTLIGHT APPARATUS AND MANUFACTURING METHOD THEREOF

(71) Applicant: LEEDARSON AMERICA INC., Smyrna, GA (US)

(72) Inventor: Yongchuan Li, Smyrna, GA (US)

(73) Assignee: LEEDARSON AMERICA INC., Symrna, GA (US)

( * ) Notice: Subject to any disclaimer, the term of this patent is extended or adjusted under 35 U.S.C. 154(b) by 104 days.

(21) Appl. No.: 15/680,097

(22) Filed: Aug. 17, 2017

(65) Prior Publication Data

US 2019/0056071 A1 Feb. 21, 2019

(51) Int. Cl.

| | |
|---|---|
| ***F21K 9/233*** | (2016.01) |
| ***F21V 29/89*** | (2015.01) |
| ***F21V 5/00*** | (2018.01) |
| ***F21V 23/00*** | (2015.01) |
| ***F21V 23/06*** | (2006.01) |
| ***F21V 29/83*** | (2015.01) |
| ***F21K 9/237*** | (2016.01) |
| ***F21Y 115/10*** | (2016.01) |

(52) U.S. Cl.

CPC ..... *F21K 9/233* (2016.08); *F21K 9/237* (2016.08); *F21V 5/002* (2013.01); *F21V 23/003* (2013.01); *F21V 23/006* (2013.01); *F21V 23/06* (2013.01); *F21V 29/83* (2015.01); *F21V 29/89* (2015.01); *F21Y 2115/10* (2016.08)

(58) Field of Classification Search

CPC ..... F21K 9/233; F21K 9/237; F21V 29/83; F21V 29/89; F21V 5/002; F21V 23/003

See application file for complete search history.

(56) References Cited

U.S. PATENT DOCUMENTS

| | | | | |
|---|---|---|---|---|
| 9,644,824 | B2 * | 5/2017 | Dassanayake et al. ... | F21V 7/08 |
| 2009/0058288 | A1 * | 3/2009 | Bertram ..... | H01L 51/5268 313/504 |
| 2009/0189541 | A1 * | 5/2009 | Crawford et al. ..... | F21L 4/02 315/294 |
| 2011/0170289 | A1 * | 7/2011 | Allen ..... | F21V 13/12 362/235 |
| 2015/0198315 | A1 * | 7/2015 | Dassanayake ..... | F21V 9/08 362/363 |
| 2016/0273717 | A1 * | 9/2016 | Krames ..... | A61M 21/00 |
| 2017/0299144 | A1 * | 10/2017 | Rosen ..... | F21V 5/007 |
| 2018/0192484 | A1 * | 7/2018 | Stopa ..... | G02B 19/0066 |

* cited by examiner

*Primary Examiner* — Thien M Le
*Assistant Examiner* — Asifa Habib
(74) *Attorney, Agent, or Firm* — Chun-Ming Shih; LanWay IPR Services

(57) ABSTRACT

A spotlight apparatus has a LED plate, a lens plate, a cup body, a driver plate and two metal pins. The lens plate has a central lens and a plurality of micro optical structures. The cup body has a dome portion, a tube portion and a bottom portion. The dome portion and the tube portion are manufactured together as a single body. A portion of light emitting from the LED plate runs through the central lens of the lens plate to form a focus light beam and another portion of light emitting from the LED modules running through the plurality of micro optical structures to form soft light. Two input terminals of the driver plate are inserted into the two metal pins.

17 Claims, 6 Drawing Sheets

SPOTLIGHT APPARATUS AND MANUFACTURING METHOD THEREOF

FIELD OF INVENTION

The present invention is related to a spotlight apparatus and manufacturing method thereof and more particularly related to a LED spotlight apparatus and manufacturing method thereof.

BACKGROUND

Spotlight devices are widely used in various areas, including to better show a painting or a portion of a dinner table. However, spotlight devices usually takes higher price and thus making them less adopted than needed. Current spotlight devices usually have more complicated structures and thus make them having higher cost.

Therefore, it would be a technical challenge to design a simpler structure of spotlight device and would be even better if heat dissipation and assembling factors are also considered in such design.

SUMMARY OF INVENTION

According to a first embodiment of the present invention, a spotlight apparatus has a LED plate, a lens plate, a cup body and a driver plate.

The LED plate has a plurality of LED modules, a metal plate and two connectors. The plurality of LED modules and the two connectors are mounted on the metal plate. The LED modules may each be a single LED chip or multiple LED chips formed as a module.

A lens plate has a central lens and a plurality of micro optical structures around the central lens. Different lens plate may be prepared for generating spotlight apparatuses with different light beam characteristics while the other components kept unchanged.

Therefore, a detachable connection structure like screw or clips may be designed so that users may change a different lens plate to fit their needs. For example, a user may buy such spotlight apparatus with a number of lens plates with different central lens settings. The user may replace the default lens plate with another lens plate, e.g. to emit a more wide light beam or a narrower light beam. In addition, different colors of lens plate may be designed so that users may change a different color filter to affect the light beam from such spotlight apparatus.

The cup body has a dome portion, a tube portion and a bottom portion. The dome portion and the tube portion are manufactured together as a single body. The lens plate is fixed to a top peripheral end of the dome portion of the cup body. The LED plate is disposed inside the dorm portion so that a portion of light emitting from the LED modules running through the central lens of the lens plate to form a focus light beam and another portion of light emitting from the LED modules running through the plurality of micro optical structures to form soft light. The plurality of micro optical structures may be designed to diffuse the light or made of tiny cave, blocks or dots. The central lens may also be made of multiple lens structures instead of a single lens.

The driver plate contains driver circuits, two output terminals and two input terminals.

The two metal pins are integrated to the bottom portion of the cup body. The two input terminals of the driver plate are inserted into the two metal pins and the two output terminals connected to the LED plate.

In a specific example, there is a neck portion between the dorm portion and the tube portion. There is a first distance between where the LED plate is disposed and the neck portion. There is a second distance between the top peripheral and the neck portion. The first distance is smaller than half of the second distance and larger than one fourth of the second distance.

In another specific example, there are diffusion optical structures formed on the dorm portion and the tube portion, e.g. to increase overall light output and to prevent visual exposing of the components of the spotlight apparatus.

In another specific example, the two metal pins have openings respectively for receiving the two input terminals of the driver plate. In other words, the two input terminals may not need to be welded but just plugged into the metal pins. This helps significant decrease manufacturing cost.

In another specific example, the two metal pins are metal hollow tubes. For example, the two metal pins are cylinder shape with central opening.

In another specific example, a portion of the input terminals of the driver plate is deformed when the input terminals are inserted into the openings of the two metal pins to keep better connection between the input terminals and the two metal pins. The input terminal may be made with elastic metal so that when the input terminals are plugged into the metal pins, the input terminals has form changing and increasing force to fix to the metal pins.

In another specific example, the two metal pins are molded with the bottom portion of the cup body. For example, the metals are not connected to the bottom portion of the cup body by screw structures. Instead, the metal pins are placed in a molding device while molding the bottom portion of the cup body.

In a specific example, the dome portion, the tube portion and the bottom portion of the cup body are together formed with Polycarbonate (PC) material as a single body. Please note that other plastic or material may be adopted if they allow light to go through.

In another specific example, the two metal pins are inserted in a molding device when the molding device is used for produce the cup body so that the two metal pins are molded with the bottom portion of the cup body.

In a specific example, the lens plate is made of Polycarbonate material as a single body. In other words, the cup body and the lens plate may be made of same PC material thus making the overall cost even lower.

In a specific example, the tube portion of the cup body has a track trench for guiding and inserting the driver plate. With such design, the driver plate may be reliably fixed to the tube portion of the cup body.

In a specific example, the driver plate has a base plate with metal material for heat dissipation. For example, the base plate may be made of aluminum.

To further increase heat dissipation, heat dissipation gel may be applied between the track trench and the driver plate to enhance heat dissipation.

Alternatively, heat dissipation glue may be applied between the track trench and the driver plate to enhance heat dissipation and connection reliability between the track trench and the driver plate.

In a specific example, the lens plate has a transparent hollow cup facing the LED modules.

According to another embodiment of the present invention, a method for manufacturing a spotlight apparatus has following steps.

Two metal pins are placed in a molding device.

A cup body is formed with the molding device. The cup body has a dorm portion, a tube portion and a bottom portion. In addition, the two metal pins are molded with the bottom portion.

A driver plate is placed in the cup body so that two input pins of the driver plate are inserted into the two metal pins.

A LED plate is mounted on the driver plate so that two output terminals of the driver plate are electrically connected to the LED plate.

A lens plate is placed to a top peripheral end of the dome portion of the cup body.

In a specific example of the method, the cup body is made of Polycarbonate material.

In a specific example of the method, the tube portion of the cup body has a track trench for guiding and inserting the driver plate.

In a specific example of the method, the metal pins two metal pins are two metal hollow tubes, and the two input terminals of driver plate are inserted into the two metal hollow tubes.

In a specific example of the method, the lens plate has a central lens and a plurality of micro optical structures so that a portion of light emitting from the LED plate running through the central lens of the lens plate to form a focus light beam and another portion of light emitting from the LED plate running through the plurality of micro optical structures to form soft light.

DETAILED DESCRIPTION

Figure 1:
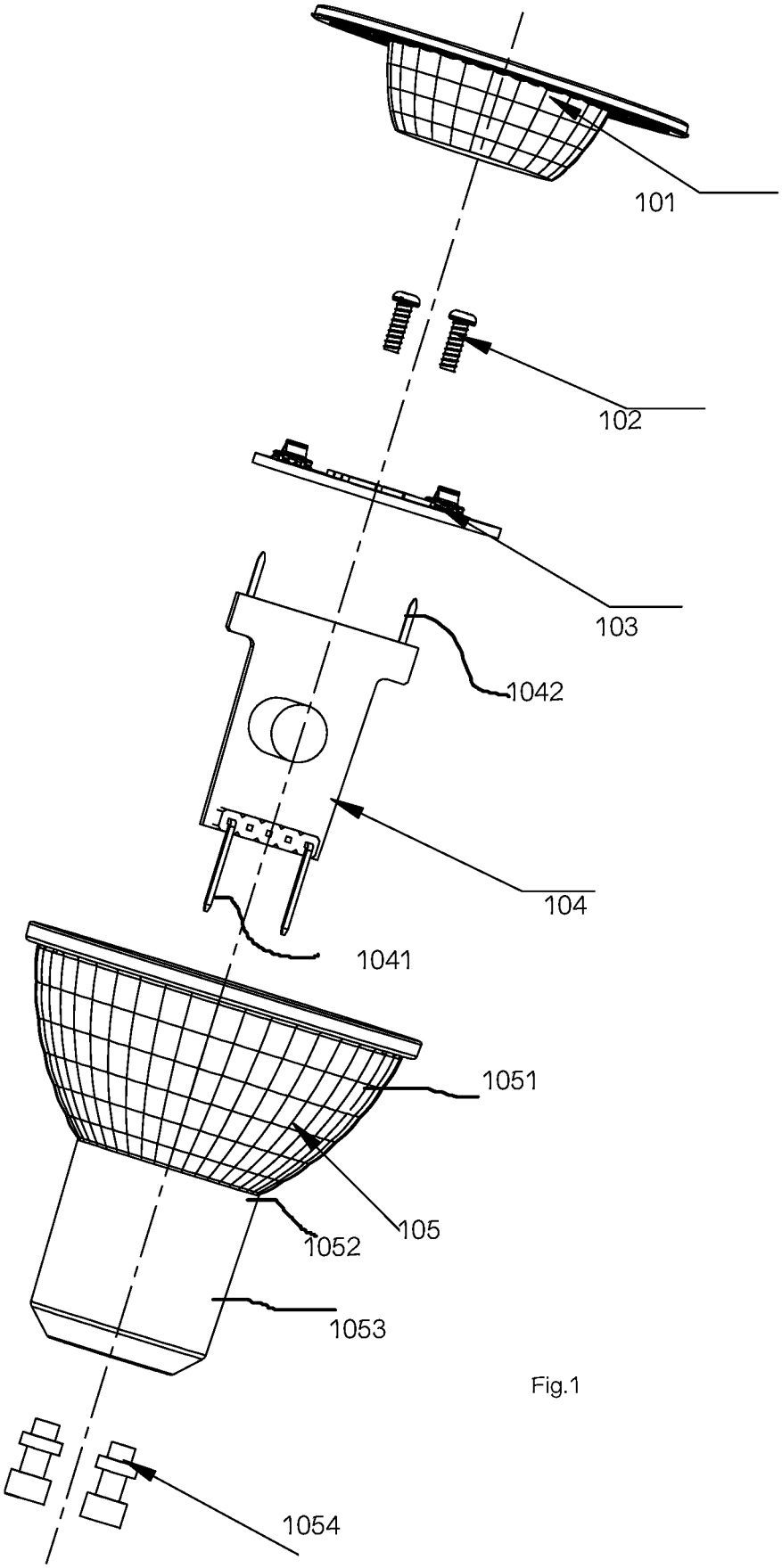
FIG. 1 illustrates an exploded diagram of components of a spotlight apparatus embodiment according to the present invention.
Figure 5:
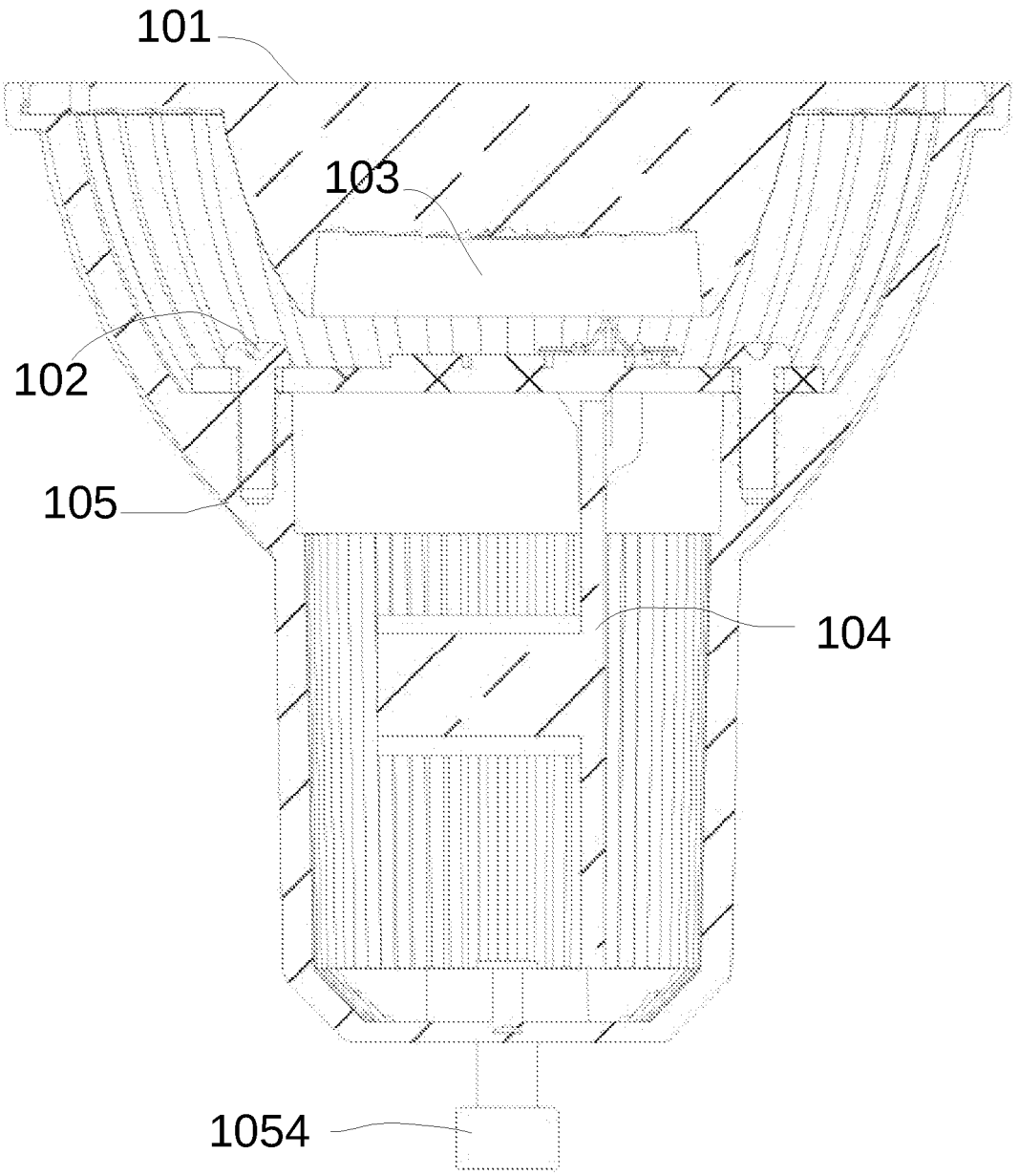
FIG. 5 is a side view of the spot light embodiment of FIG. 1 when the spotlight is assembled.

Please refer to FIG. 1 and FIG. 5. FIG. 1 illustrates an exploded diagram of components of a spotlight apparatus. FIG. 5 illustrates a side view of cross-sectional diagram of the components of FIG. 1 when they are assembled together.

The spotlight apparatus has a LED plate 103, a lens plate 101, a cup body 105, a driver plate 104, a pair of screws 102 for fixing the components.

The LED plate 103 has a plurality of LED modules, a metal plate and two connectors. The plurality of LED modules and the two connectors are mounted on the metal plate. The LED modules may each be a single LED chip or multiple LED chips formed as a module.

Figure 2A:
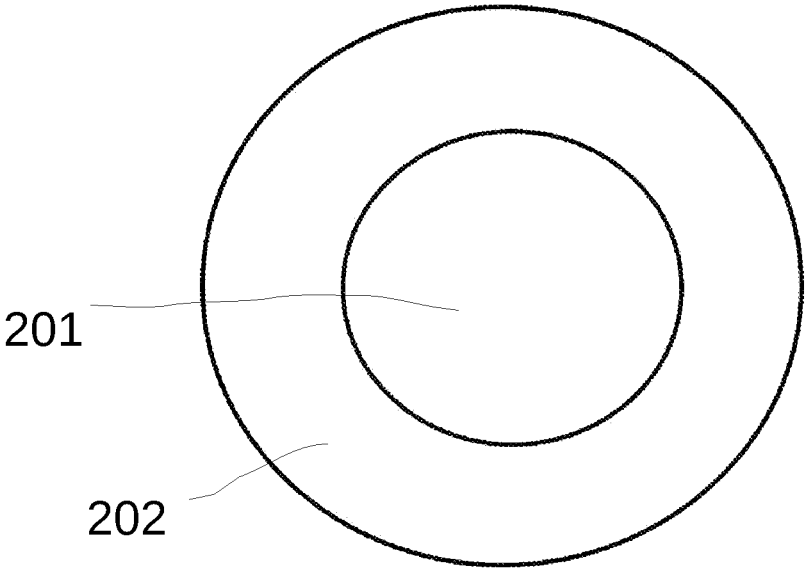
FIG. 2A illustrates an embodiment of a lens plate.
Figure 2B:
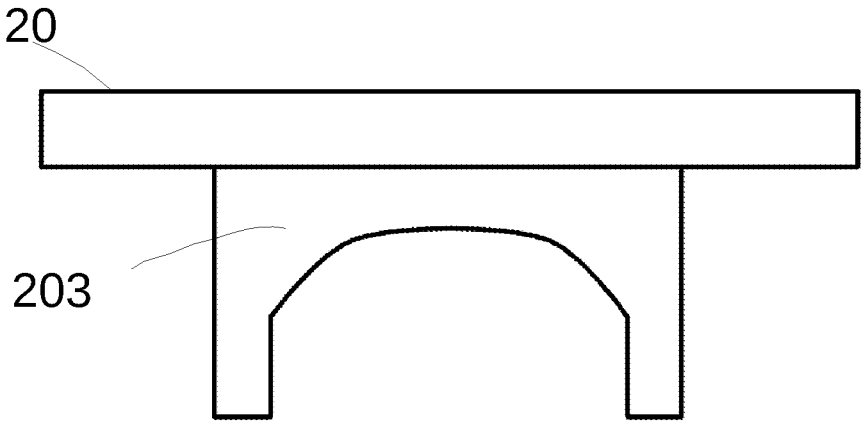
FIG. 2B illustrates side view of FIG. 2A.

Please refer to FIG. 2A and FIG. 2B, which illustrate a lens plate example. In FIG. 2A and FIG. 2B, the lens plate is a circular shape and has a central lens 201 and a plurality of micro optical structures 202 around the central lens. Micro optical structures are patterns including concave or other structure that may guide or change light paths to achieve certain optical effect. FIG. 2B is a side view of FIG. 2A. The lens plate 20 has a transparent hollow cup 203 structure for guiding light entering the central lens 201. The central lens 201 may be made of a single lens or multiple lens that generates the effect of creating a spotlight beam.

Different lens plate may be prepared for generating spotlight apparatuses with different light beam characteristics while the other components kept unchanged.

Therefore, a detachable connection structure like screw or clips may be designed so that users may change a different lens plate to fit their needs. For example, a user may buy such spotlight apparatus with a number of lens plates with different central lens settings. The user may replace the default lens plate with another lens plate, e.g. to emit a more wide light beam or a narrower light beam. In addition, different colors of lens plate may be designed so that users may change a different color filter to affect the light beam from such spotlight apparatus.

Please refer back to FIG. 1. The cup body 105 has a dome portion 1051, a tube portion 1053 and a bottom portion, which facing to and integrated with two metal pins 1054. The dome portion 1051 and the tube portion 1053 are manufactured together as a single body. The lens plate 101 is fixed to a top peripheral end of the dome portion 1051 of the cup body 105. The LED plate 103 is disposed inside the dorm portion 1051 so that a portion of light emitting from the LED modules running through the central lens of the lens plate 101 to form a focus light beam and another portion of light emitting from the LED modules running through the plurality of micro optical structures to form soft light. The plurality of micro optical structures may be designed to diffuse the light or made of tiny cave, blocks or dots. The central lens may also be made of multiple lens structures instead of a single lens.

The driver plate 104 contains driver circuits, two output terminals and two input terminals.

The two metal pins 1054 are integrated to the bottom portion of the cup body 105. The two input terminals 1041 of the driver plate 104 are inserted into the two metal pins 1054 and the two output terminals 1042 connected to the LED plate 103.

In a specific example, there is a neck portion 1052 between the dorm portion and the tube portion.

Figure 3:
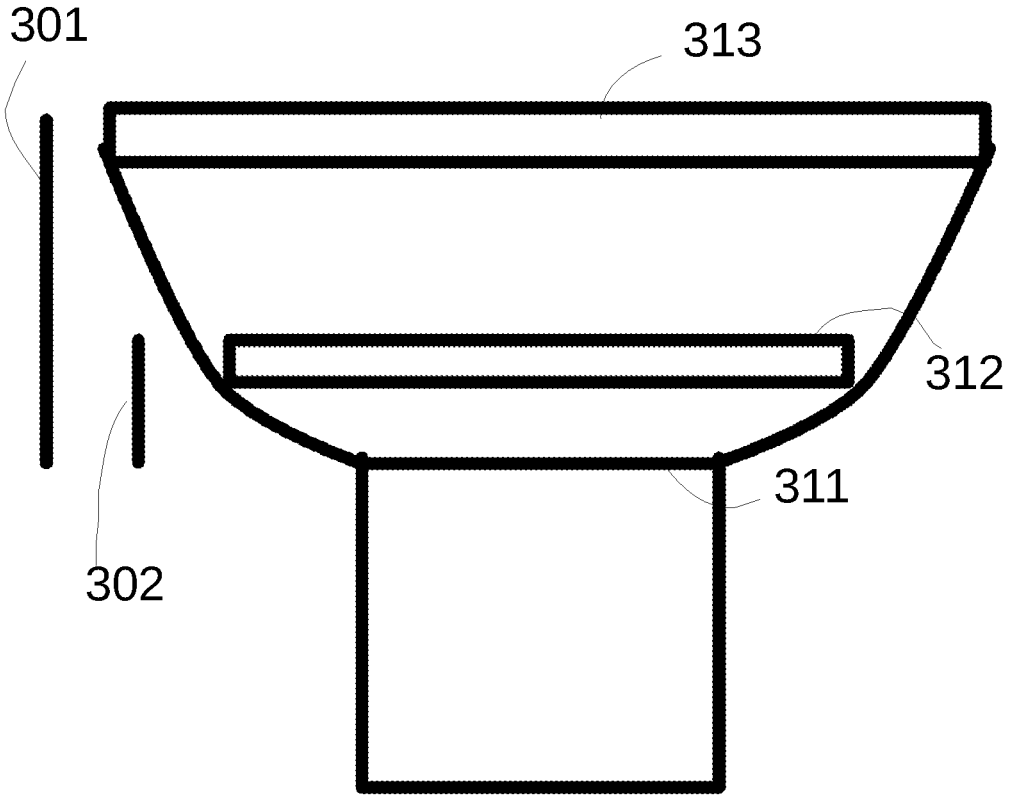
FIG. 3 illustrates a cup body embodiment.

Please also refer to FIG. 3. There is a first distance 302 between where the LED plate 312 is disposed and the neck portion 311. There is a second distance 301 between the top peripheral 313 and the neck portion 311. The first distance 302 is smaller than half of the second distance 301 and larger than one fourth of the second distance 301. For example, the first distance 302 is about ⅓ of the second distance 301. Such arrangement makes both light efficiency and heat dissipation for leaving space for heat movement.

In another specific example, there are diffusion optical structures formed on the dorm portion and the tube portion, e.g. to increase overall light output and to prevent visual exposing of the components of the spotlight apparatus.

In another specific example, the two metal pins have openings respectively for receiving the two input terminals of the driver plate. In other words, the two input terminals may not need to be welded but just plugged into the metal pins. This helps significant decrease manufacturing cost.

In another specific example, the two metal pins are metal hollow tubes. For example, the two metal pins are cylinder shape with central opening.

In another specific example, a portion of the input terminals of the driver plate is deformed when the input terminals are inserted into the openings of the two metal pins to keep better connection between the input terminals and the two metal pins. The input terminal may be made with elastic metal so that when the input terminals are plugged into the metal pins, the input terminals has form changing and increasing force to fix to the metal pins.

In another specific example, the two metal pins are molded with the bottom portion of the cup body. For example, the metals are not connected to the bottom portion of the cup body by screw structures. Instead, the metal pins are placed in a molding device while molding the bottom portion of the cup body.

In a specific example, the dome portion, the tube portion and the bottom portion of the cup body are together formed with Polycarbonate (PC) material as a single body. Please note that other plastic or material may be adopted if they allow light to go through.

Figure 4:
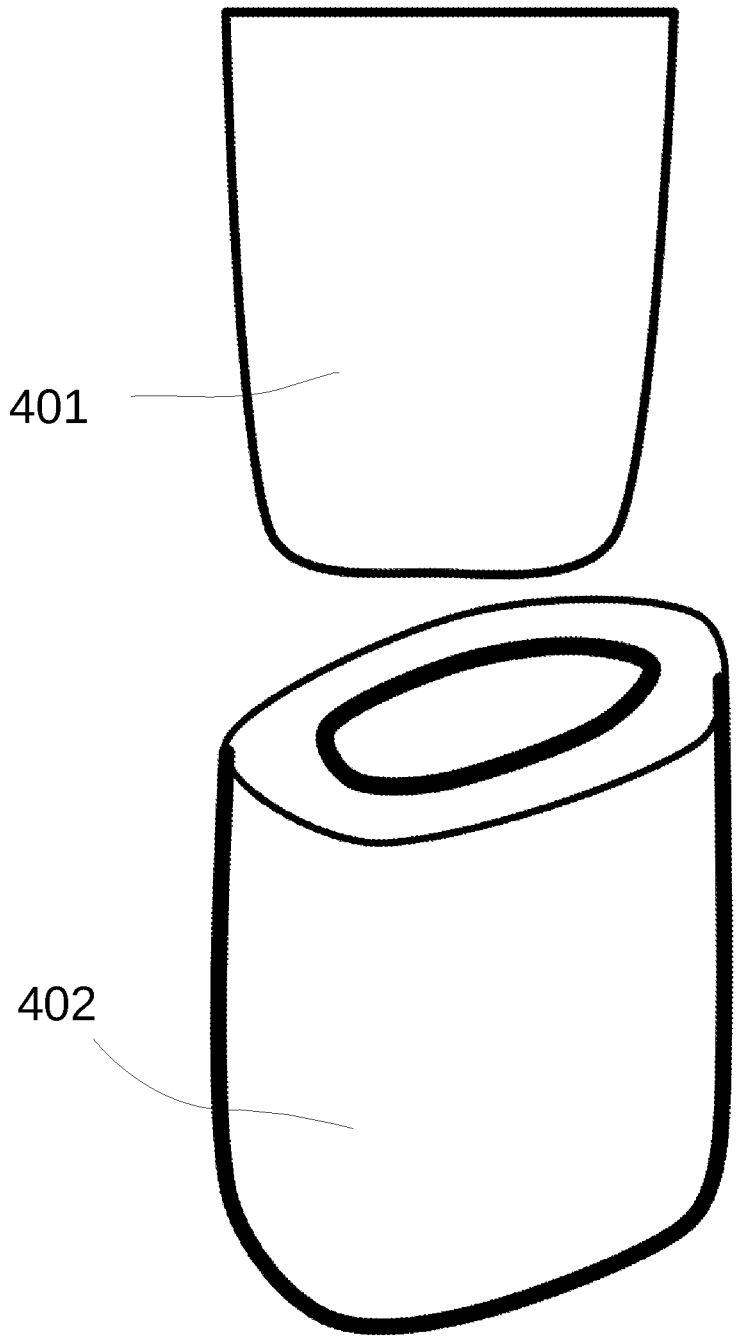
FIG. 4 illustrates a diagram of metal pins and input terminals.

Please refer to FIG. 4, which illustrates interaction between an input terminal of a driver plate 401 and a metal pins 402. The front end of the input terminal is inserted into a hole of the metal pins 402. In addition, a deformation of the inserted portion of the input terminal 401 would help fixing better for the input terminal 401 and the metal pins 402. In another specific example, the two metal pins are inserted in a molding device when the molding device is used for produce the cup body so that the two metal pins are molded with the bottom portion of the cup body.

In a specific example, the lens plate is made of Polycarbonate material as a single body. In other words, the cup body and the lens plate may be made of same PC material thus making the overall cost even lower.

In a specific example, the tube portion of the cup body has a track trench for guiding and inserting the driver plate. With such design, the driver plate may be reliably fixed to the tube portion of the cup body.

In a specific example, the driver plate has a base plate with metal material for heat dissipation. For example, the base plate may be made of aluminum.

To further increase heat dissipation, heat dissipation gel may be applied between the track trench and the driver plate to enhance heat dissipation.

Alternatively, heat dissipation glue may be applied between the track trench and the driver plate to enhance heat dissipation and connection reliability between the track trench and the driver plate.

In a specific example, the lens plate has a transparent hollow cup facing the LED modules.

Figure 6:
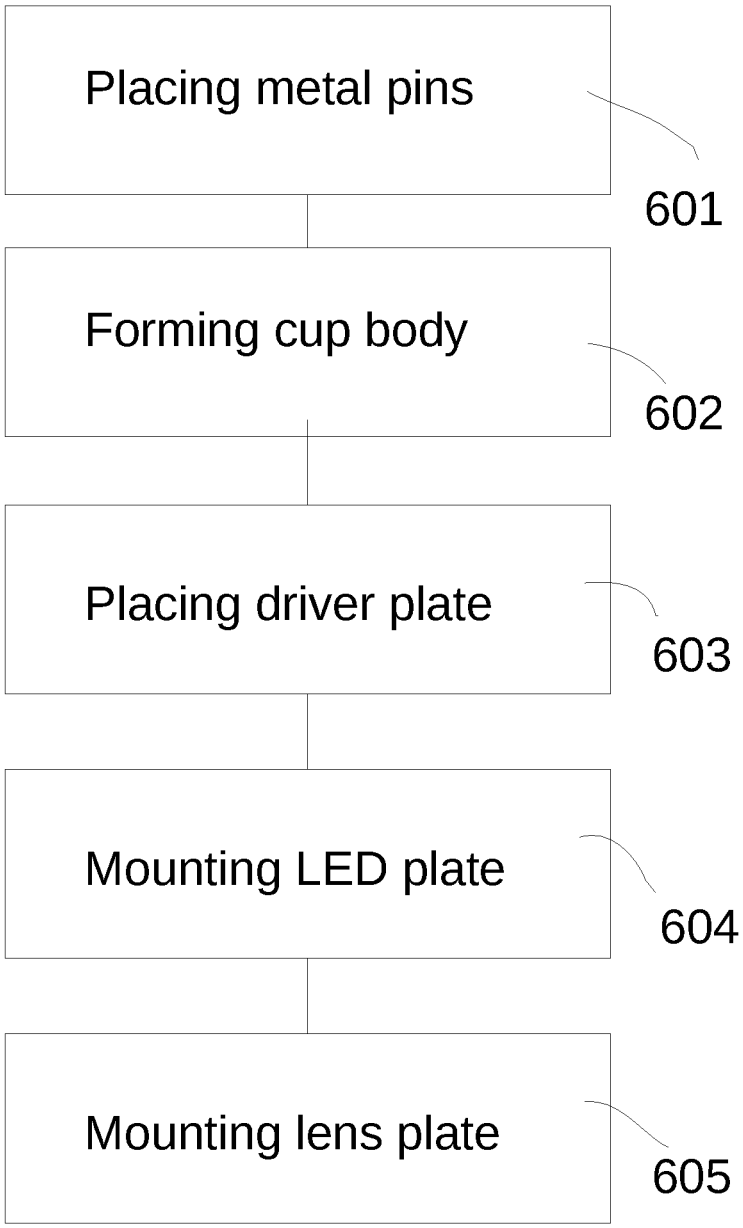
FIG. 6 is a flowchart for illustrating a method for manufacturing a spotlight apparatus.

Please refer to FIG. 6, which is a flowchart illustrating a method for manufacturing a spotlight apparatus that has following steps.

Two metal pins are placed in a molding device (step 601).

A cup body is formed with the molding device (step 602). The cup body has a dorm portion, a tube portion and a bottom portion. In addition, the two metal pins are molded with the bottom portion.

A driver plate is placed in the cup body (step 603) so that two input pins of the driver plate are inserted into the two metal pins.

A LED plate is mounted on the driver plate (step 604) so that two output terminals of the driver plate are electrically connected to the LED plate.

A lens plate is placed (step 605) to a top peripheral end of the dome portion of the cup body.

In a specific example of the method, the cup body is made of Polycarbonate material.

In a specific example of the method, the tube portion of the cup body has a track trench for guiding and inserting the driver plate.

In a specific example of the method, the metal pins two metal pins are two metal hollow tubes, and the two input terminals of driver plate are inserted into the two metal hollow tubes.

In a specific example of the method, the lens plate has a central lens and a plurality of micro optical structures so that a portion of light emitting from the LED plate running through the central lens of the lens plate to form a focus light beam and another portion of light emitting from the LED plate running through the plurality of micro optical structures to form soft light.

Please be noted that other variations based on the same inventive spirit should be regarded falling within the protection scopes of the present invention. For example, the metal pins mentioned above may be designed as screw with associated screw grooves on the bottom portion of the cup body. Other ways for integrating the metal pins with the bottom portion of the cup body may also be adopted under different design needs.

The embodiments mentioned above should not be interpreted as limitation for the present invention. Persons of ordinary skilled in the art would be able to create equivalent designs under protection scopes.

The invention claimed is:

1. A spotlight apparatus comprising:

a LED plate comprising a plurality of LED modules, a metal plate and two connectors, the plurality of LED modules and the two connectors being mounted on the metal plate;

a lens plate, comprising a central lens and a plurality of micro optical structures around the central lens;

a cup body comprising a dome portion, a tube portion and a bottom portion, the dome portion and the tube portion being manufactured together as a single body, the lens plate being fixed to a top peripheral end of the dome portion of the cup body, the LED plate being disposed inside the dome portion so that a portion of light emitting from the LED modules running through the central lens of the lens plate to form a focus light beam and another portion of light emitting from the LED modules running through the plurality of micro optical structures to form soft light;

a driver plate containing driver circuits, two output terminals and two input terminals; and two metal pins integrated to the bottom portion of the cup body, the two input terminals of the driver plate inserted into the two metal pins and the two output terminals connected to the LED plate, wherein the two metal pins have openings respectively for receiving the two input terminals of the driver plate, the two metal pins are metal hollow tubes.

2. The spotlight apparatus of claim 1, wherein there is a neck portion between the dome portion and the tube portion, there is a first distance between where the LED plate is disposed and the neck portion, there is a second distance between the top peripheral and the neck portion, and the first distance is smaller than half of the second distance and larger than one fourth of the second distance.

3. The spotlight apparatus of claim 1, wherein diffusion optical structures are formed on the dome portion and the tube portion.

4. The spotlight apparatus of claim 1, wherein a portion of the input terminals of the driver plate is deformed when the input terminals are inserted into the openings of the two metal pins to keep better connection between the input terminals and the two metal pins.

5. The spotlight apparatus of claim 1, wherein the two metal pins are molded with the bottom portion of the cup body.

6. The spotlight apparatus of claim 1, wherein the dome portion, the tube portion and the bottom portion of the cup body are together formed with Polycarbonate material as a single body.

7. The spotlight apparatus of claim 6, wherein the two metal pins are inserted in a molding device when the molding device is used for produce the cup body so that the two metal pins are molded with the bottom portion of the cup body.

8. The spotlight apparatus of claim 6, wherein the lens plate is made of Polycarbonate material as a single body.

9. The spotlight apparatus of claim 1, wherein the tube portion of the cup body has a track trench for guiding and inserting the driver plate.

10. The spotlight apparatus of claim 9, wherein the driver plate has a base plate with metal material for heat dissipation.

11. The spotlight apparatus of claim 9, further comprising heat dissipation gel between the track trench and the driver plate to enhance heat dissipation.

12. The spotlight apparatus of claim 9, further comprising heat dissipation glue between the track trench and the driver plate to enhance heat dissipation and connection reliability between the track trench and the driver plate.

13. The spotlight apparatus of claim 1, wherein the lens plate has a transparent hollow cup facing the LED modules.

14. A method for manufacturing a spotlight apparatus, comprising:

placing two metal pins in a molding device;

forming a cup body with the molding device, wherein the cup body has a dome portion, a tube portion and a bottom portion, the two metal pins are molded with the bottom portion;

placing a driver plate in the cup body so that two input pins of the driver plate are inserted into the two metal pins;

mounting a LED plate on the driver plate so that two output terminals of the driver plate are electrically connected to the LED plate; and mounting a lens plate to a top peripheral end of the dome portion of the cup body, wherein the lens plate has a central lens and a plurality of micro optical structures around the central lens, wherein the metal pins two metal pins are two metal hollow tubes, and the two input terminals of driver plate are inserted into the two metal hollow tubes.

15. The method of claim 14, wherein the cup body is made of Polycarbonate material.

16. The method of claim 14, wherein tube portion of the cup body has a track trench for guiding and inserting the driver plate.

17. The method of claim 14, wherein a portion of light emitting from the LED plate running through the central lens of the lens plate to form a focus light beam and another portion of light emitting from the LED plate running through the plurality of micro optical structures to form soft light.

* * * * *